US009264813B2

(12) United States Patent
Riggs et al.

(10) Patent No.: US 9,264,813 B2
(45) **Date of Patent: *Feb. 16, 2016**

(54) VIRTUAL SURROUND FOR LOUDSPEAKERS WITH INCREASED CONSTANT DIRECTIVITY

(75) Inventors: Jason Riggs, Portland, OR (US); Jason N. Linse, Camas, WA (US); Rong Hu, Vancouver, WA (US); Joy E. Lyons, Vancouver, WA (US)

(73) Assignee: Logitech, Europe S.A., Lausanne (CH)

( * ) Notice: Subject to any disclaimer, the term of this patent is extended or adjusted under 35 U.S.C. 154(b) by 795 days.

This patent is subject to a terminal disclaimer.

(21) Appl. No.: 13/038,114

(22) Filed: Mar. 1, 2011

(65) Prior Publication Data

US 2011/0216926 A1 Sep. 8, 2011

Related U.S. Application Data

(63) Continuation-in-part of application No. 12/717,781, filed on Mar. 4, 2010, now Pat. No. 8,542,854.

(51) Int. Cl.
*H04R 5/02* (2006.01)

(52) U.S. Cl.
CPC ..... *H04R 5/02* (2013.01)

(58) Field of Classification Search
CPC ..... G10L 2021/02166; G10L 21/0208; H04R 3/005; H04R 2410/07; H04R 2430/20; H04R 2430/21; H04R 2430/23; H04R 25/407; H04R 1/406; H04R 2201/401
USPC ..... 381/1, 17–19, 300, 97, 58, 332, 111, 381/98, 87, 103, 306, 388, 77, 386, 305, 381/310, 309, 304; 700/94
See application file for complete search history.

(56) References Cited

U.S. PATENT DOCUMENTS 4,888,804 A 12/1989 Gefvert
5,870,484 A 2/1999 Greenberger (Continued)

FOREIGN PATENT DOCUMENTS

CN 1636420 A 7/2005
CN 202565456 U 11/2012

(Continued)

OTHER PUBLICATIONS

Office Action from China dated Jul. 14, 2011, issued in related Chinese Patent Application No. 201120061562.9 filed Mar. 4, 2011, 1 page.

(Continued)

*Primary Examiner* — Lun-See Lao
(74) *Attorney, Agent, or Firm* — Kilpatrick Townsend & Stockton LLP

(57) ABSTRACT

A speaker system includes a first array of transducers in a speaker enclosure and, and at least a second array of transducers in the speaker enclosure. The second array is a low-frequency array and the first array is a high-frequency array. The transducers in the first array are configured to have an operating frequency region covering at least the frequency ranges of the first array and the second array, and the transducers in the second are configured to have an operating frequency region covering at least the frequency ranges of the first array and the second array. The speaker system further includes an input port, and a controller operatively coupled with the input port. The controller is configured to provide an electronic-audio signal to the transducers such that the first array and the second array are tuned to different center frequencies and are a two stage dipole beamforming array.

32 Claims, 10 Drawing Sheets

(56) References Cited

U.S. PATENT DOCUMENTS

| | | | | |
|---|---|---|---|---|
| 6,731,765 | B1 | 5/2004 | Sotome | |
| 6,934,394 | B1 | 8/2005 | Anderson | |
| D549,691 | S | 8/2007 | Gould et al. | |
| 7,995,778 | B2 * | 8/2011 | Berardi et al. | 381/310 |
| 8,041,061 | B2 | 10/2011 | Hughes, II et al. | |
| 8,194,863 | B2 * | 6/2012 | Takumai et al. | 381/27 |
| 8,542,854 | B2 * | 9/2013 | Riggs et al. | 381/300 |
| 2001/0031060 | A1 | 10/2001 | Carver | |
| 2002/0047646 | A1 | 4/2002 | Lys et al. | |
| 2002/0113555 | A1 | 8/2002 | Lys et al. | |
| 2002/0154783 | A1 * | 10/2002 | Fincham | 381/17 |
| 2002/0172370 | A1 | 11/2002 | Ito | |
| 2002/0181727 | A1 | 12/2002 | Shen et al. | |
| 2002/0186859 | A1 | 12/2002 | Atia | |
| 2003/0021423 | A1 | 1/2003 | Wood | |
| 2003/0068051 | A1 | 4/2003 | Bottum | |
| 2003/0091195 | A1 | 5/2003 | Godfrey et al. | |
| 2003/0103637 | A1 | 6/2003 | Huang | |
| 2003/0161479 | A1 | 8/2003 | Yang et al. | |
| 2003/0209383 | A1 | 11/2003 | Whitman et al. | |
| 2004/0030561 | A1 | 2/2004 | Chen | |
| 2004/0049304 | A1 | 3/2004 | Chen | |
| 2004/0057590 | A1 | 3/2004 | Lo | |
| 2004/0076306 | A1 | 4/2004 | Pan | |
| 2004/0110561 | A1 | 6/2004 | Kawamura | |
| 2004/0123327 | A1 | 6/2004 | Fai et al. | |
| 2004/0142718 | A1 | 7/2004 | Kim | |
| 2004/0142748 | A1 | 7/2004 | Loose et al. | |
| 2004/0156512 | A1 | 8/2004 | Parker | |
| 2004/0224731 | A1 | 11/2004 | Ahn | |
| 2005/0089181 | A1 | 4/2005 | Polk | |
| 2005/0089182 | A1 * | 4/2005 | Troughton et al. | 381/307 |
| 2005/0157894 | A1 | 7/2005 | Andrews et al. | |
| 2005/0222841 | A1 | 10/2005 | McDowell | |
| 2005/0226449 | A1 | 10/2005 | Young | |
| 2005/0238189 | A1 | 10/2005 | Tsai | |
| 2005/0244010 | A1 | 11/2005 | Kuwahara et al. | |
| 2005/0249373 | A1 | 11/2005 | Yamashita | |
| 2005/0265172 | A1 | 12/2005 | Stankiewicz et al. | |
| 2005/0282631 | A1 | 12/2005 | Bonney et al. | |
| 2006/0072773 | A1 | 4/2006 | Hughes, II et al. | |
| 2006/0078129 | A1 * | 4/2006 | Nakamichi | 381/18 |
| 2006/0115091 | A1 | 6/2006 | Kim et al. | |
| 2006/0165247 | A1 | 7/2006 | Mansfield et al. | |
| 2006/0215848 | A1 | 9/2006 | Ambourn | |
| 2007/0009131 | A1 | 1/2007 | Kuan | |
| 2007/0041599 | A1 | 2/2007 | Gauthier et al. | |
| 2007/0087686 | A1 | 4/2007 | Holm et al. | |
| 2007/0098198 | A1 | 5/2007 | Hildebrandt | |
| 2007/0154041 | A1 | 7/2007 | Beauchamp | |
| 2007/0160350 | A1 | 7/2007 | Ikeda et al. | |
| 2007/0211904 | A1 | 9/2007 | Sakagami | |
| 2007/0237340 | A1 | 10/2007 | Pfanzagl-Cardone | |
| 2007/0253575 | A1 | 11/2007 | Melanson | |
| 2007/0263888 | A1 | 11/2007 | Melanson | |
| 2007/0263890 | A1 | 11/2007 | Melanson | |
| 2007/0274548 | A1 | 11/2007 | Huang | |
| 2008/0063211 | A1 | 3/2008 | Kusunoki | |
| 2008/0089522 | A1 | 4/2008 | Baba et al. | |
| 2008/0090220 | A1 | 4/2008 | Freeman et al. | |
| 2008/0101631 | A1 | 5/2008 | Jung et al. | |
| 2008/0131085 | A1 | 6/2008 | Ikeda et al. | |
| 2008/0131094 | A1 | 6/2008 | Ikeda et al. | |
| 2008/0159545 | A1 | 7/2008 | Takumai et al. | |
| 2008/0159571 | A1 | 7/2008 | Hooley | |
| 2008/0165979 | A1 | 7/2008 | Takumai | |
| 2008/0181416 | A1 | 7/2008 | Jung | |
| 2008/0266394 | A1 | 10/2008 | Groenenboom | |
| 2008/0267413 | A1 | 10/2008 | Faller | |
| 2008/0273721 | A1 | 11/2008 | Walsh | |
| 2009/0028358 | A1 | 1/2009 | Suzuki | |
| 2009/0060237 | A1 | 3/2009 | Konagai et al. | |
| 2009/0175472 | A1 | 7/2009 | Gunnarsson | |
| 2011/0112664 | A1 * | 5/2011 | Ong | 700/94 |
| 2011/0216926 | A1 | 9/2011 | Riggs | |

FOREIGN PATENT DOCUMENTS

| | | | | |
|---|---|---|---|---|
| DE | 0000024339934 | A1 | 3/1975 | |
| DE | 400360152 | A1 | 5/1992 | |
| DE | 697 36 941 | T2 | 11/2006 | |
| DE | 69736941 | T2 | 3/2007 | |
| DE | 10 2008059 036 | A1 | 5/2010 | |
| WO | 93/14607 | A1 | 7/1993 | |
| WO | WO 93/14607 | * | 7/1993 | H04R 5/02 |
| WO | WO 97/09851 | | 3/1997 | |
| WO | WO 97/41711 | | 11/1997 | |
| WO | WO 99/39546 | | 5/1999 | |
| WO | WO 00/24226 | | 4/2000 | |
| WO | WO 02/065815 | | 8/2002 | |
| WO | WO 02/078396 | | 10/2002 | |
| WO | WO 02/091799 | | 11/2002 | |
| WO | WO 03/067928 | | 8/2003 | |
| WO | WO 2005/046287 | | 5/2005 | |
| WO | WO 2005/067347 | | 7/2005 | |
| WO | WO 2005/089018 | | 9/2005 | |
| WO | WO 2006/057521 | | 6/2006 | |
| WO | WO 2006/079086 | | 7/2006 | |
| WO | WO 2007/127757 | | 11/2007 | |
| WO | WO 2007/127781 | | 11/2007 | |
| WO | WO 2007/127822 | | 11/2007 | |

OTHER PUBLICATIONS

Office Action from China dated Feb. 2, 2012, issued in related Chinese Patent Application No. 201120061562.9 filed Mar. 4, 2011, 1 page.

Office Action from China dated May 22, 2013, issued in related Chinese Patent Application No. 201110057780.X filed Mar. 4, 2011, 18 pages.

German Examination Report dated Apr. 10, 2013, issued in related German Patent Application No. 102011005110.4 filed Sep. 9, 1997, 8 pages.

Office Action dated Sep. 11, 2012 in U.S. Appl. No. 12/717,781, filed Mar. 4, 2010, 23 pages.

German Examination Report dated May 8, 2012, issued in related German Patent Application No. 10 2011 005 110.4. English Translation.

Chinese Office Action dated Nov. 4, 2013, issued in related Chinese Patent Application No. 20111057780.X, filed Mar. 4, 2011, 8 pages.

German Examination Report dated Aug. 4, 2012, issued in related German patent Application No. 10 2011 005 110.4 (with English Translation), 14 pages.

* cited by examiner

VIRTUAL SURROUND FOR LOUDSPEAKERS WITH INCREASED CONSTANT DIRECTIVITY

CROSS REFERENCE TO RELATED APPLICATION

This application is a continuation-in-part application of U.S. patent application Ser. No. 12/717,781, filed Mar. 4, 2010, titled "VIRTUAL SURROUND FOR LOUDSPEAKERS WITH INCREASED CONSTANT DIRECTIVITY," of Jason Riggs et al., and is incorporated by reference herein in its entirety for all purposes.

BACKGROUND OF THE INVENTION

In traditional surround sound systems, a listener places 5 or more speakers at various positions around a listening position (sometimes also referred to as a listening area) to create an immersive sound experience for a listener. Each of the speakers in the system typically receives its own audio signal from an audio source, and consequently, the listener typically must wire each of the speakers to the audio source. The speakers in the audio system then produce sound that converges at the listening position to properly create a surround sound experience for the listener.

Virtual surround is a surround sound technique that can make sound appear to come from locations other than the location of the actual speakers in order to create a surround sound experience for a listener. As a result, virtual surround sound systems typically use fewer speakers than traditional surround sound systems, and the speakers in a virtual surround sound system are usually located in front of the listener. Virtual surround sound systems are thus more practical for a variety of different setups, such as with a personal computing system or a television.

Virtual surround sound widens the soundscape beyond the physical location of the speakers used to produce the sound, and is based on how humans localize sound. Humans localize sound using three methods: 1) Interaural Intensity Difference (IID), 2) Interaural Time Difference (ITD), and 3) Spectrally, with the Head Related Transfer Function (HRTF). Interaural Intensity Difference occurs when a sound is louder at one ear than at the other ear. This can occur when the sound source is closer to one of the ears. Similarly, Interaural Time Difference occurs when the sound reaches one ear before it reaches the other ear because the sound source is closer to one of the ears. This can cause a difference in time and therefore a difference in phase between the ears. A Head Related Transfer Function refers to the unique spectral shaping of sound as it reflects off of the pinna (outer ear), head, and shoulders of the listener. The spectral shaping can vary depending on the location of the sound source. Additionally, the spectral shaping can vary depending on the particular listener.

Virtual surround sound may employ one or more different techniques to create the impression on a listener that sound is coming from a location other than the location of the speakers based on one or more of the three above methods. For example, dipole beamforming is one method for creating virtual surround using IID. Dipole pairs of transducers can be used to artificially increase the difference in sound level between the ears. The transducers in a dipole pair are driven out of phase with each other in order to create a null for certain frequencies or channels, and a delay is used to steer the radial direction of the null. The result is that sound for certain frequencies or channels is more intense at one ear of the listener compared to the other ear, and the listener is left with the impression that the sound is originating from a location other than the actual location of the transducers producing the sound.

For more constant directivity, the array can be frequency band-limited. The distance between the centers of the transducers used to form a dipole pair is defined to be equal to a quarter-wavelength. The optimal center frequency of the array can be derived from this wavelength. The array is optimized over approximately 4 octaves: 2 octaves above and below the center frequency. Above this frequency range, the distance between the transducers can become large relative to the wavelength of sound being produced, and radial lobes are created as the frequency increases. The implication of this is that the sound at one ear may no longer be louder than at the other ear, and the virtual surround effect is reduced or lost. Below the optimized frequency range, the efficiency of sound production can decrease as sound from the out of phase transducers cancels.

The transducers used in a dipole beamforming array are generally chosen for their dispersion characteristics in the targeted array frequency range. For example, woofers have good efficiency and near omni-directional radiation at lower frequencies. Woofers thus are a good choice for a lower frequency array. At higher frequencies, woofers start to beam and have less consistent directionality. This phenomenon is related to the size of the transducer relative to the wavelength of sound that it produces. In contrast, tweeters are physically smaller and thus have better dispersion for higher frequencies with smaller wavelengths. Therefore, tweeters are a good choice for a high frequency array. However, higher frequencies can be difficult to properly implement with a dipole beamforming array because higher frequencies have smaller wavelengths, and it may not always be physically possible to place tweeters (or other transducers) close enough together for an optimized dipole beamforming system.

For a more efficient system design it may be desirable to minimize the number of transducers. In this case, horizontally displaced transducers of different types may be used provided there is sufficient overlap in their regions of operation. For example, a simple design may have a woofer and a tweeter combining to cover a wide frequency bandwidth where the woofer plays the lower frequencies and the tweeter plays the higher frequencies, which may be controlled by some signal processing to send the appropriate frequencies to the appropriate transducer. If the woofer and tweeter are capable of producing sound in the same frequency region then the region of overlap may be processed as an array, with the array center frequency determined by the quarter wavelength equal to the center to center spacing of the woofer and tweeter. This may result in the woofer playing outside its omnidirectional frequency range, but the off-axis roll-off of the woofer at higher frequencies may be a minor effect compared to the lobing resulting from using an array outside the usable frequency region. The benefit of extending the array processing to higher frequencies results in a better surround sound experience while potentially reducing size and system complexity.

Accordingly, it would be desirable to have a better virtual surround system that produces constant directivity across a wide range of frequencies in a small system that is useful for a variety of different setups. A number of different techniques are known in the art for creating virtual surround sound. For example, U.S. Application Pub. No. 2006/0072773 entitled "Dipole and monopole surround sound speaker system," U.S. Application Pub. No. 2009/0060237 entitled "Array Speaker System," U.S. Application Pub. No. 2008/0273721 entitled "Method for spatially processing multichannel signals, processing module, and virtual surround-sound systems," and U.S. Application Pub. No. 2003/0021423 entitled "System for transitioning from stereo to simulated surround sound" all show different virtual surround systems. However, each of these systems could be improved to have more constant directivity across a wider range of frequencies.

BRIEF SUMMARY OF THE INVENTION

Various embodiments provide virtual surround with only 1 or 2 enclosures that can be placed in front of the listener. These embodiments also have substantially constant directivity across a range of frequencies. Various embodiments accomplish this by combining techniques that can be effective at different frequency ranges. For example, some embodiments combine dipole beamforming with pointing transducers to the side (i.e., away from the listening area). Pointing a transducer to the side provides directionality due to transducer beaming at higher frequencies. Additional directionality from "shading" can occur when the sound is shaded by the edge of the speaker box. Sound from the side firing transducers that is reflected off nearby objects or walls can also increase the sense of spaciousness, listener envelopment, and the apparent source width.

According to one embodiment of the present invention, a speaker system includes a speaker enclosure, a first array of transducers mounted in the speaker enclosure and having a first lateral displacement, and at least a second array of transducers in the speaker enclosure and having a second lateral displacement, which is larger than the first lateral displacement. The second array is a low-frequency array and the first array is a high-frequency array. The transducers included in the first array are configured to have an operating frequency region covering at least the frequency ranges of the first array and the second array, and the transducers included in the second are configured to have an operating frequency region covering at least the frequency ranges of the first array and the second array. The speaker system further includes a speaker input port, and a controller operatively coupled with the speaker input port, wherein the controller is configured to provide an electronic-audio signal to the transducers such that the first array and the second array are tuned to different center frequencies and are a two stage dipole beamforming array. According to one specific embodiment, the second array is a mixed frequency array.

According to another specific embodiment, the first array and the second array together include at least a first transducer, a second transducer, a third transducer, and a fourth transducer. The first transducer and the second transducer form the low-frequency array, and the first transducer and the third transducer form the high-frequency array, and the second transducer and the fourth transducer form another high-frequency array.

According to another specific embodiment of the present invention, the first and the second transducers are woofers configured for a low-frequency region of operation. The third and the fourth transducers are tweeters configured for a high-frequency region of operation. The woofers and tweeters have a frequency region of operation that overlaps and are configured for dipole beamforming of the high-frequency array. According to one embodiment, the first transducer, second transducer, third transducer, and fourth transducer have substantially similar frequency regions of operation.

According to another specific embodiment, the controller is configured to: i) route a left channel of the electronic-audio signal to the first transducer and the third transducer, ii) route a right channel of the electronic-audio signal to the second transducer and the fourth transducer, and iii) route a center channel of the electronic-audio signal to the first transducer, the second transducer, the third transducer, and/or the fourth transducer. The controller may be further configured to separate a right-surround channel of the electronic-audio signal into a first and a second frequency band, such that the first frequency band of the right-surround channel is combined with the left-surround channel and is transmitted to the first and the second transducers, wherein the right-surround channel and the left-surround channel are processed as a low frequency band-limited dipole beamforming array. According to one embodiment, a combined channel is configured to have arbitrary gains applied to component channels forming the combined channel. The second frequency band of the right-surround channel is mid-band filtered, and is processed to create a dipole beamforming array between the second and the fourth transducers, wherein a leftward spaced transducer is inverted and delayed with respect to a more rightward transducer.

The controller is configured to separate a left-surround channel of the electronic-audio signal into a first and a second frequency band. The first frequency band of the left-surround channel is combined with the right-surround channel and is transmitted to the first and the second transducers, wherein the left-surround channel and the right-surround channel are processed as a low-frequency band-limited dipole beamforming array. The second frequency band of the left-surround channel is mid-band filtered, and is processed to create a dipole beamforming array between the first and third transducers, where the more rightward transducer is inverted and delayed with respect to the more leftward transducer.

According to another specific embodiment, a combination channel of the electronic-audio signal is frequency band-limited to produce the low-frequency array. The combination channel may be configured to combine the left channel, the right channel, the center channel, the left-surround channel, and the right surround channel with arbitrary gains for surround-effect processing.

According to another specific embodiment, low-frequency signals of the first low-frequency array are determined by dipole beamforming array quarter-wavelength spacing, wherein an array usable frequency region is within +/−2 octaves about the array center frequency f_c, where f_c=c/(4d).

According to another specific embodiment, the speaker system may further include a third array of transducers having the first lateral displacement, wherein the third array is a high-frequency array and is configured to have operating frequency regions covering at least the frequency ranges of the first array, the second array; and the third array.

According to another specific embodiment, the first array and the second array are configured for combination operation with a set of side firing transducers for enclosure shading and transducer directionality to produce virtual surround. According to another specific embodiment, the speaker system further includes at least one additional laterally spaced dipole beamforming array.

These and other advantages of the embodiments of the present invention will be evident after further review of the following detailed description, claims, and attached drawings.

DETAILED DESCRIPTION OF THE INVENTION

Figure 1A:
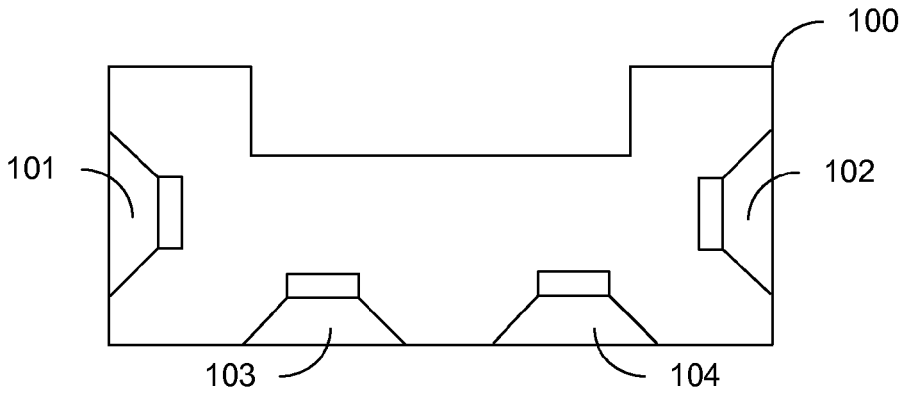
FIG. 1A shows an exemplary embodiment of a virtual surround sound system.

Various embodiments use combinations of different methods for creating virtual surround. Some of the methods used in various embodiments include: dipole beamforming, multi-stage arrays, transducer directionality, and enclosure shading. In general, each of these methods may operate over a specific frequency band in various embodiments. The use of multiple methods to create virtual sound can increase the virtual sound effect and better maintain sound quality compared to the use of a single method for creating virtual surround. Each method used to create virtual surround can be optimized for a specific system configuration based on factors such as physical locations of the transducers, directionality of the transducers, the size and shape of the enclosure, and the input signal configuration. Various embodiments allow for an intensity difference to be created for a listener across a wide range of frequencies in order to produce constant directionality.

As used herein, a "transducer" can refer to a device that converts electrical signals from an electrical source into sound for a listener. As used herein, the term "driver" may be used interchangeability with transducer.

As used herein, "dipole beamforming" can refer to a method for creating virtual surround sound based on Interaural Intensity Difference (IID). More specifically, a system that uses dipole beamforming may have one or more dipole pairs of transducers that can be used to artificially increase the difference in sound level between the ears of a listener. The transducers in a dipole pair can be driven out of phase with each other to create a null for certain frequencies or channels. A delay can be used to steer the radial direction of the null created by the transducers. Dipole beamforming may also be referred to as crosstalk cancellation.

As used herein, the transducer "region of operation" is the frequency region where a transducer operates at a high enough level to contribute to the overall sound. It is a combination of the audio frequencies sent to the driver using filtering and the dispersion characteristics of the driver itself.

As used herein, "transducer directionality," also called "driver beaming," can refer to the change in the sound polar radiation pattern from the transducer over its operating frequency range. In the lower frequency end of the operating range, the sound is radiated more uniformly in all directions. For higher frequencies, the sound intensity is generally stronger on-axis, or directly in front of the transducer, than it is off-axis. Additionally, at the higher end of the frequency operating range, there can be "lobing," where the sound intensity varies from high to low depending on the polar degree. Lobing is generally avoided because it is by definition, inconstant directivity. However, transducer directionality can be used to an advantage for virtual surround when it is used to increase the sound level at one ear relative to the other. This effect is enhanced when used with enclosure shading.

As used herein, "enclosure shading" can refer to the use of a speaker enclosure to "shade" a sound. Shading can also be caused by use of a baffle, a waveguide, or a lens. As with transducer directionality, this effect is frequency dependant. At lower frequencies, the shading effect is less. The wavelengths are longer and the sound wraps around the enclosure. At higher frequencies, the shading is increased. This effect is also dependent upon the size of the enclosure, where smaller enclosures do not shade as low in frequency as larger enclosures. As described in the next paragraph, this effect can be combined with transducer directionality for a better virtual surround effect.

To maintain the IID to higher frequency regions with more constant directivity, enclosure shading and transducer beaming are used instead of dipole beamforming. Enclosure shading and transducer beaming are ways of using the inherent directionality of objects to create the IID. When a transducer(s) is placed on the side of a speaker, the low frequency sound will bend around the enclosure and reach the listener. At higher frequencies, the enclosure begins to "shade" the sound such that higher frequencies are directed more to the side. The transducer beaming will further focus the sound. Transducer beaming occurs above the enclosure shading frequency. These two effects create a gradient in the sound field where the sound is louder at one ear than at the other ear.

Enclosure shading may occur above the enclosure transition frequency, $F_{et}$. $F_{et}=(0.6*c)/(2*\pi*R_e)$, where "c" is the speed of sound in meters per second and "$R_e$" is the effective radius of the enclosure section that is shading the side firing transducer, given in meters. The enclosure transition frequency is expressed in Hertz, or cycles/second. Similarly, the transducer beaming may occur above transducer transition frequency, $F_{tt}$, $F_{tt}=(0.6*c)/(2*\pi*R_t)$, where "c" is the speed of sound in meters per second and "$R_t$" is the effective radius of the transducer, given in meters. To allow for optimization of system components, the frequency region of transition for enclosure shading and transducer beaming shall be banded by +/− one octave, which translates to ½ the transition frequency to 2 times the transition frequency.

In addition to multi-staged dipole beamforming arrays, enclosure shading, and transducer beaming, other effects that are used to create virtual surround and widen the listening soundscape are driving the surround channels out of phase, and using the side firing transducers in conjunction with front firing transducers to maximize the width of the speaker, while maintaining full audio bandwidth at the listening position.

The operating frequency range for constant directivity of the dipole beamforming array is limited by the physical center to center distance between the transducers. At the higher frequencies, dipole beamforming does not produce a good virtual surround experience because the IID is inconstant. The radiation from the transducers interfere producing irregular "lobing," which is inconstant in directivity. A more stable IID with more constant directivity can be created by using a single side firing transducers and tuning both the transducer directionality and enclosure shading at the higher frequencies. Thus the difference in sound levels at each ear can be maintained and "lobing" can be minimized. A side-firing transducer also increases the reflected energy of the sound. The reflected sound can enhance the sensation of spaciousness, listener envelopment, and the apparent source width.

The center frequency of a dipole array is determined by the distance between the centers of the transducers used to form a dipole pair. This distance corresponds to one quarter wavelength. The center frequency, f_c, is given by the formula f_c=c/(4d), where "c" is the speed of sound and "d" is the center to center distance between the dipole array transducers.

As used herein, "multi-stage arrays" can refer to the use of different transducers and virtual surround IID generation across for different frequencies. A multi-stage dipole beamforming array has transducer pairs that are optimized for different frequency ranges. The various transducers in a multi-stage array can be configured to produce different frequencies of sound in order to create a better surround sound effect for a listener. In some embodiments, the array may comprise one or more dipole pairs that use dipole beamforming to create virtual surround sound. Such a dipole pair is typically optimized for a four octave bandwidth. Below two octaves, the efficiency of the array may be greatly reduced due to the cancellation of sound. Above two octaves, spatial interference may cause multiple unwanted nulls. Multiple nulls reduce the virtual surround effect and lead to inconstant directivity, which additionally can reduce the sound quality. In a dipole beamforming setup, the center frequency of an optimized band for a dipole pair generally occurs at the frequency corresponding to the quarter-wavelength of the transducer separation. For more constant directivity, multiple transducer arrays can be optimized to cover different frequency bands. Some frequency bands may use dipole beamforming to create virtual surround, while other frequency bands may rely on transducer directionality or enclosure shading to create a virtual surround effect.

As used herein, "controller" refers to a digital signal processor or analog circuitry that processes sound content from an audio source. The controller may be operatively coupled between a speaker input port and one or more transducers. Alternatively, or in addition, processing of sound content can be carried out by software or firmware on a computer readable medium on a computer (e.g., personal computer, laptop computer, portable music player, personal digital assistant (PDA), phone, etc.) and then multichannel content used as input into a speaker.

As used herein, "computer readable medium" for containing computer code or instructions, or portions of computer code or instructions, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, data signals, data transmissions, or any other medium which can be used to store or transmit the desired information and which can be accessed by the computer. Based on the disclosure and teaching provided herein, a person of ordinary skill in the art will appreciate other ways and/or methods to implement the various embodiments.

As used herein, "listening area" or "listening position" refers to the intended position of a listener or the area around a listener in a surround sound system or a virtual surround sound system. This area or position is used in the design of the surround sound system to create a good surround sound experience for a listener.

Figure 4:
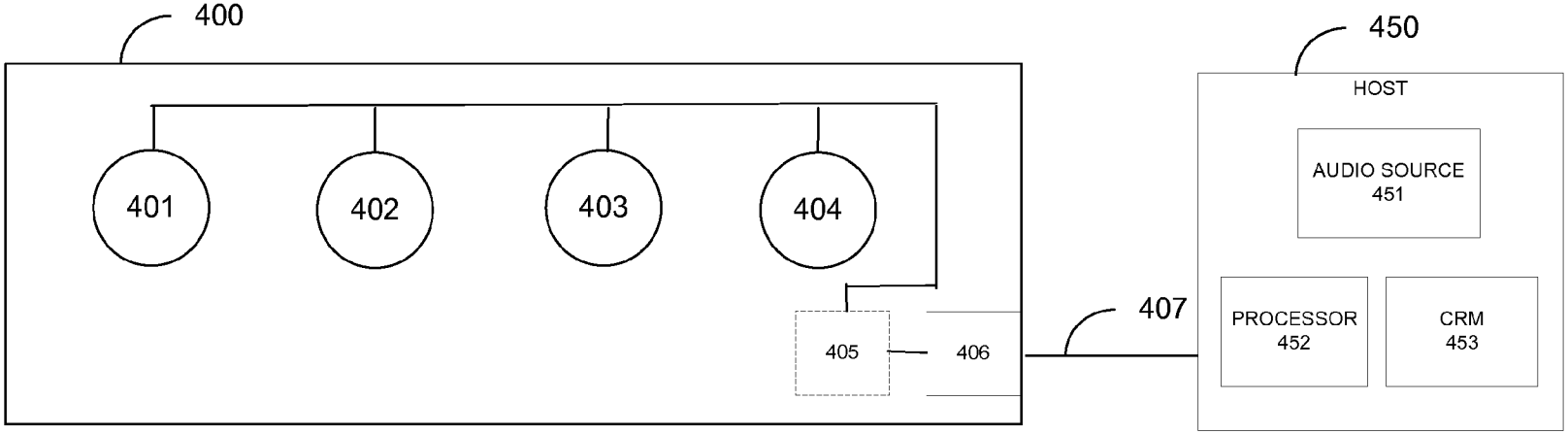
FIG. 4 shows a block diagram of an exemplary system according to an embodiment of the invention.

FIG. 4 shows an exemplary virtual surround sound system according to some embodiments of the invention. FIG. 4 shows a speaker 400 with transducers 401, 402, 403 and 404. An optional controller 405 for virtual surround sound processing may be operatively coupled between a speaker input port 406 and one or more transducers 401-404. Transducers 402 and 403 may make up a first array, and transducers 401 and 404 may make up a second array.

FIG. 4 further shows a host 450 with an audio source 451 (e.g., disk, MP3, stream, 5.1 or 7.1 channel content, stereo content, etc.), a processor 452, and a computer readable medium (CRM) 453. Virtual surround processing can be done at the host (e.g., by software or firmware on CRM 453) alternatively or in addition to processing at optional controller 405. The speaker 400 may be operatively coupled to the host 450 via a wired or wireless connection 407. The signal may be amplified after processing and before it is sent to transducers 401-404.

The speaker 400 may comprise any combination of the above described components. For example, the speaker 400 may include the audio source 451, controller 405, amplification of the signal, and the transducers 401-404. In the alternative, just the processor 405, amplification, and the transducers 401-404 may be in the speaker. In another alternative, only amplification and transducers may be in the speaker. In yet another alternative, only the transducers 401-404 may be in the speaker.

Sound Bar

According to one embodiment, multiple transducers are placed within a single enclosure. Some of the transducers are pointed straight ahead toward a listening position, while some of the transducers are pointed to the side, away from the listening position. FIG. 1A illustrates an example such an embodiment in the form of a sound bar. According to some embodiments, a sound bar can be configured so that it can attach to a computer monitor that is in front of the listening position.

In the embodiment illustrated in FIG. 1A, two transducers, 103 and 104, are pointed straight ahead toward a listening area while two transducers, 101 and 102, are pointed to the side. FIG. 1A illustrates this arrangement of transducers from a top-down perspective. Side transducers 101 and 102 can be used to take advantage of directionality and shading. Five channels of sound can be used in the embodiment illustrated in FIG. 1A: left 110, right 120, center 130, left surround 140, and right surround 150. According to some embodiments, a separate subwoofer may also be used in the system to help improve the generation of low frequency sound.

In the embodiment illustrated in FIG. 1A, a two stage dipole beamforming array is used with transducer directionality and enclosure shading for enhanced virtual surround with more constant directivity. The two stage array can be broken up into low and medium frequency arrays. These arrays are used to create virtual surround sound effectively at their respective frequencies. According to one embodiment, low frequencies are considered to be frequencies up to 1 khz, medium frequencies are considered to be frequencies between 1 khz and 4 khz, and high frequencies are considered to be frequencies greater than 4 khz. The low and medium frequencies may use dipole beamforming to create virtual surround sound, while the high frequencies may rely on directionality and enclosure shading to create virtual surround. A low frequency array can be created using side transducers 101 and 102, a medium frequency array can be creating using front transducers 103 and 104, and the side transducers 101 and 102 can use high frequency directionality and enclosure shading. More details on how these sound arrays are created are given below.

Referring to FIG. 1A, four separate transducers are shown in the enclosure 100: left firing 101, right firing 102, left front 103, and right front 104. Each of the transducers may be full range transducers capable of producing frequencies ranging from 200 hz to 20 khz. The left firing 101 and right firing 102 transducers, which can be used for low frequency dipole beamforming, may be spaced apart by roughly the quarter wavelength of the center of the frequency range outputted by the array. According to one embodiment, the spacing between left firing 101 and right firing 102 is 20 cm as measured from the center of the transducers. Thus, according to this embodiment, the wavelength of the center frequency for this dipole pair is 80 cm. 80 cm roughly corresponds to a frequency of 400 hz. Similarly, the left front 103 and right front 104 transducers may be placed approximately 3-4 cm apart. This spacing leads to a wavelength of approximately 16-20 cm, or around 2 khz for the center frequency.

FIGS. 1B-1F show the signal processing used to implement a three-stage array according to one embodiment. As with the embodiment shown in FIG. 1A, five channels of sound from an audio source can be processed: left 110, right 120, center 130, left surround 140, and right surround 150. These channels can be sent to various embodiments from an audio source using well-known means.

Figure 1B:
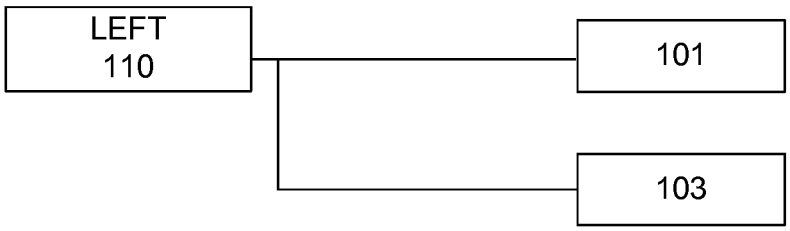
FIGS. 1B-F show exemplary signal processing diagrams for the embodiment illustrated in FIG. 1A.

FIG. 1B shows the signal processing for the left channel 110. The audio signals from the left channel 110 are sent to the left firing 101 transducer, and to the left front 103 transducer.

Figure 1C:
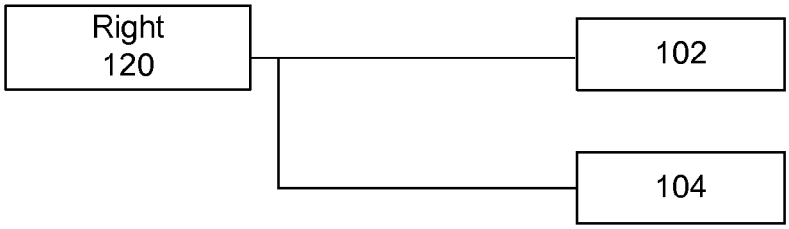

FIG. 1C shows the signal processing for the right channel 120. The audio signals from the right channel 120 are sent to the right firing 102 transducer, and to the right front 104 transducer.

Figure 1D:
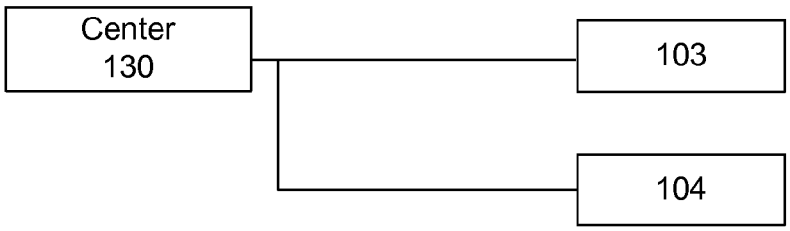

FIG. 1D shows the signal processing for the center channel 130. The audio signals from the center channel 130 are sent to the left front 103 and the right front 104 transducers.

Figure 1E:
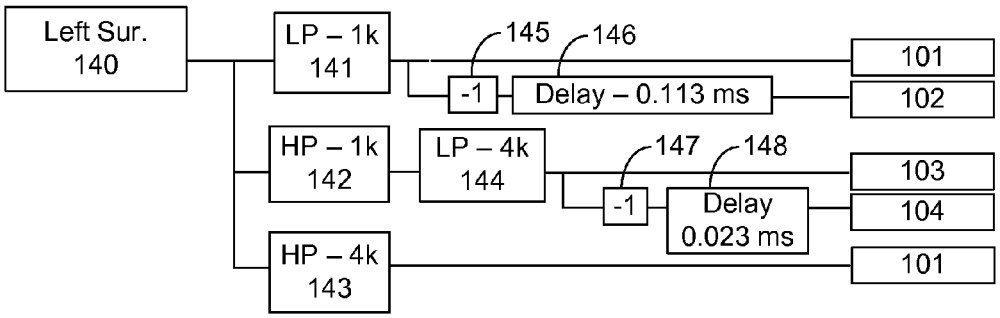

FIG. 1E shows the signal processing for the left surround channel 140. As illustrated in FIG. 1E, the left surround channel 140 has its signal broken up into a low frequency range (<1 khz) by a low pass filter 141, a medium frequency range (between 1 khz and 4 khz) by a combination of a low pass filter 144 and a high pass filter 142, and a high frequency range (>4 kz) by a high pass filter 143.

The high frequencies from the left surround channel 140, after passing through high pass filter 143, are then sent to the left firing 101 transducer.

The medium frequencies from the left surround 140 channel, after passing through high pass filter 142 and low pass filter 144, are then further split. The medium frequency signal from the left surround 140 channel is sent to the left front 103 transducer. The medium frequency signal from the left surround 140 channel is also inverted by an inverter 147 and sent to the right front 104 transducer after a 0.023 millisecond (ms) delay 148. The time delay can be tuned for listening position.

The low frequencies from the left surround 140 channel, after passing through low pass filter 141, are also further split. The low frequency signal from the left surround 140 channel is sent to the left firing 101 transducer. The low frequency signal from the left surround 140 channel is also inverted by an inverter 145 and sent to the right firing 102 transducer after a 0.113 ms delay 146. The time delay can be tuned for desired listening position.

Figure 1F:
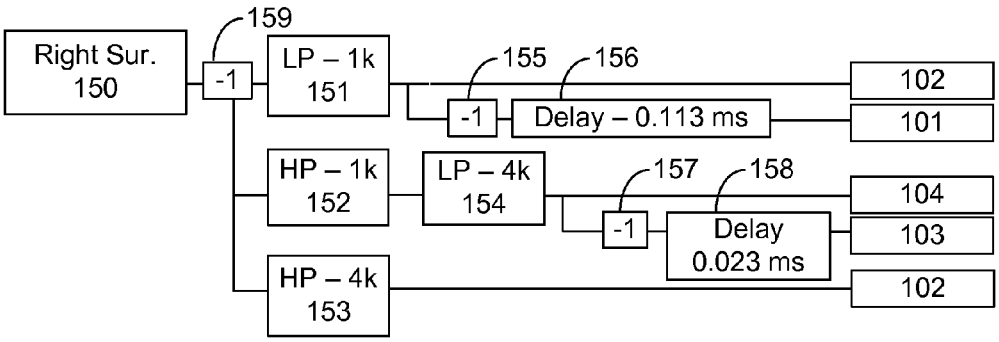

FIG. 1F shows the signal processing for the right surround channel 150. Similar to the left surround channel 140, the right surround channel 150 has its signal broken up into a low frequency range (<1 khz) by a low pass filter 151, a medium frequency range (between 1 khz and 4 khz) by a combination of a low pass filter 154 and a high pass filter 152, and a high frequency range (>4 khz) by a high pass filter 153. However, one difference between the left surround channel 140 and the right surround channel 150 is that the right surround channel has its signal inverted by an inverter 159 before the signal is divided by frequency. Alternately, the left surround channel could be inverted instead of the right surround channel. The condition is that they are out of phase with each other.

The inverted high frequencies from the right surround channel 150, after passing through high pass filter 153, are then sent to the right firing 102 transducer.

The inverted medium frequencies from the right surround 150 channel, after passing through high pass filter 152 and low pass filter 154, are then further split. The inverted medium frequency signal from the right surround 150 channel is sent to the right front 104 transducer. The inverted medium frequency signal from the right surround 150 channel is also inverted again by an inverter 157 and sent to the left front 103 transducer after a 0.023 ms delay 158. The time delay can be tuned for listening position.

The inverted low frequencies from the right surround 150 channel, after passing through low pass filter 151, are also further split. The inverted low frequency signal from the right surround 150 channel is sent to the right firing 102 transducer. The inverted low frequency signal from the right surround 150 channel is also again inverted by an inverter 155 and sent to the left firing 101 transducer after a 0.113 ms sample delay 156. The time delay can be tuned for listening position.

As can be seen from the above signal processing diagrams, a low frequency array is created using the two side firing transducers. The low frequencies from the left surround channel 140 are sent to the left firing 101 transducer and the right firing 102 transducer, with the signal to the right firing 102 transducer inverted and delayed so as to create a virtual surround sound effect using dipole beamforming. This can create the impression to a listener in the listening area that the left surround channel 140 is being created from a speaker to the far left of the listener. The low frequencies from the right surround channel are first inverted and then sent to the left firing 101 transducer and the right firing 102 transducer. The signal to the left firing 101 transducer are inverted and delayed so as to create a virtual surround using dipole beamforming. As a result, the listener is given the impression that the right surround channel 140 is being created from a speaker to the far right of the listener.

A medium frequency array is created from the left and right firing channels 140 and 150 using the two transducers in the front of the enclosure 103 and 104. The medium frequency array, by inverting and delaying signals as described above, uses dipole beamforming to create a virtual surround sound for those frequencies.

High frequency IID is created using the two side firing transducers 101 and 102. The high frequencies may not create their virtual surround through the use of dipole beamforming in the same way that the low and medium frequencies may do. Rather, the high frequencies rely on the directionality of the sound from left firing 101 and right firing 102 to create virtual surround using the transducer directionality and the shading of the enclosure. This is used for the surround channel content. The side-firing transducer also increases the reflected energy, which enhances the sensation of spaciousness and apparent source width.

Stand

Figure 2A:
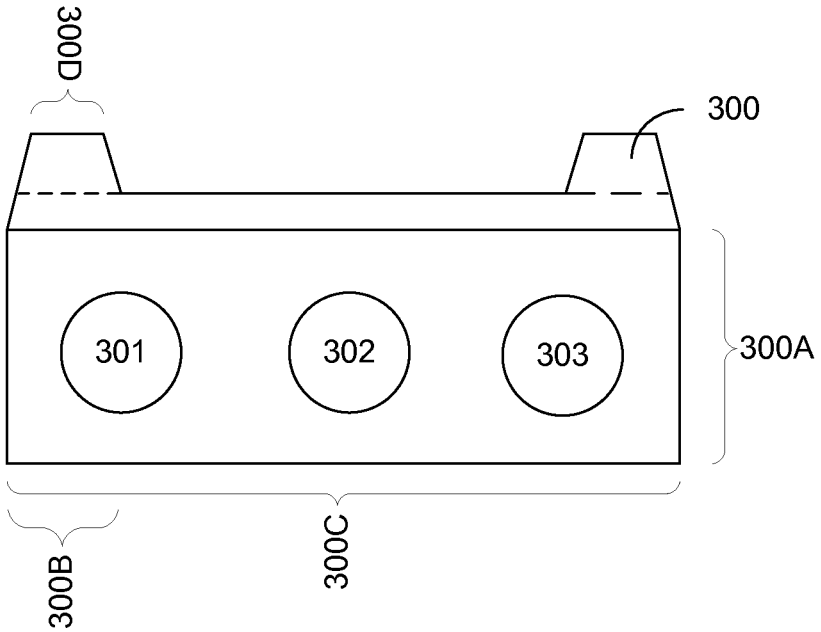
FIGS. 2A-2D show an exemplary embodiment of a virtual surround sound system.

According to one embodiment, multiple transducers are placed within a single enclosure. Some of the transducers are pointed straight ahead toward a listening area, while some of the transducers are pointed to the side. FIG. 2A illustrates an example such an embodiment in the form of a stand speaker. Five channels of sound can be used in the embodiment illustrated in FIG. 2A: left 320, right 340, center 330, left surround 360, and right surround 370. Various embodiments may also include a subwoofer 310 that is separate from the stand. Various embodiments may include a separate subwoofer channel 350 for the subwoofer 310.

In the embodiment illustrated in FIGS. 2A-2D, five full-range transducers are shown. According to some embodiments, each of the transducers may be 2" drivers. Note that the drawings shown in FIGS. 2A-D are not shown to scale. In the embodiment illustrated in FIGS. 2A-D, three transducers are pointed straight at the listening area, while two transducers are pointed to the side to take advantage of directionality and shading. As will be explained in more detail below, the side transducers can be used to create the surround channels. Additionally, a subwoofer that is separate from the stand speaker shown in FIG. 2A can be used to produce the lowest frequencies.

FIG. 2A shows the front view of a stand 300 embodiment. In this view, the left 301, center 302, and right 303 transducers are clearly visible. According to one embodiment, the height 300A of the front is 12.5 cm. According to one embodiment, the distance from the edge of the stand 300 to the center of the left transducer 301 is 4.25 cm (as represented as 300B in FIG. 2A). According to one embodiment, the width 300C of the stand is 36.5 cm. According to one embodiment, the width of the back edge 300D is 11 cm. The two back edges of the stand rise up at an angle relative to the front of the stand and contain the side firing transducers. The below diagrams show this shape in more detail.

Figure 2B:
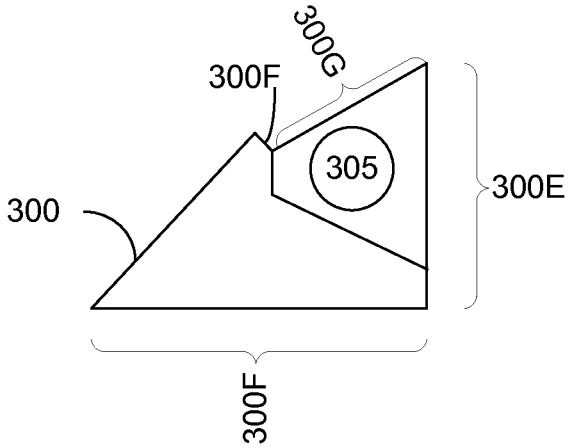
Figure 2C:
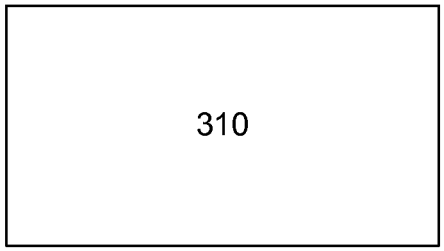

FIG. 2B shows the right side view of a stand 300 embodiment. In the view shown in FIG. 2B, the right firing 305 transducer is clearly shown. If a left view was shown, the view would look similar to FIG. 2B with the left firing 304 transducer. According to one embodiment, the depth 300F of the stand 300 is 15 cm. According to one embodiment, the height 300E of the back edge is 16 cm. According to one embodiment, the edge 300G of the stand above the side firing transducer is 11.5 cm. According to one embodiment, edge 300F is 2 cm.

FIG. 2B shows a subwoofer 310 that can be used with some embodiments. The subwoofer may have its own channel for audio signals.

Figure 2D:
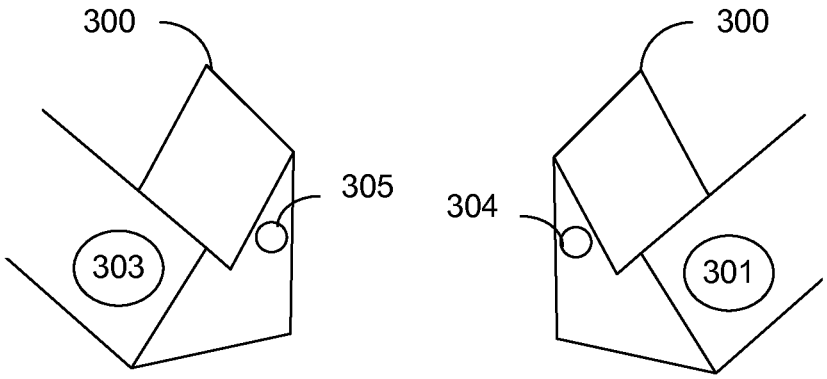

FIG. 2D shows the left and right view of an embodiment of the stand. In FIG. 2D, the left firing 304 and right firing 305 can be seen in relation to the right 303 and left 301 transducers.

FIGS. 2E-2J show the signal processing used to implement a virtual surround effect according to one embodiment. As with the embodiment shown in FIG. 2A, five channels of sound can be used with various embodiments: left 320, right 340, center 330, left surround 360, and right surround 370. Various embodiments may include a separate subwoofer channel 350 for the subwoofer 310. These channels can be sent to various embodiments from an audio source using well-known means.

Figure 2E:
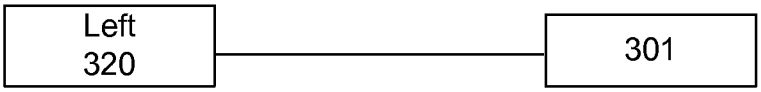
FIGS. 2E-J show exemplary signal processing diagrams for the embodiment illustrated in FIGS. 2A-2D.

FIG. 2E shows the signal processing for the left channel 320. The signal from the left channel 320 is sent to the left transducer 301.

Figure 2F:
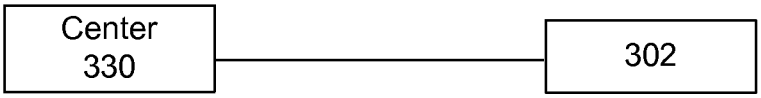

FIG. 2F shows the signal processing for the center channel 330. The signal from the center channel 330 is sent to the center transducer 302.

Figure 2G:
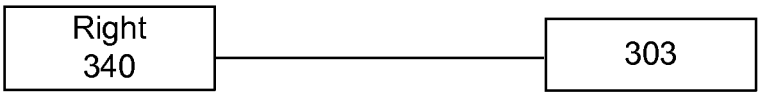

FIG. 2G shows the signal processing for the right channel 340. The signal from the right channel 340 is sent to the right transducer 303.

Figure 2H:
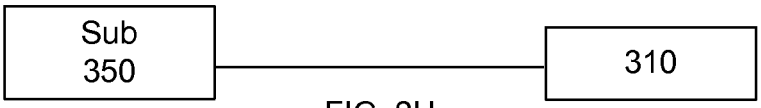

FIG. 2H shows the signal processing for the subwoofer channel 350 according to some embodiments. The signal from the subwoofer channel 350 is sent to the subwoofer 310.

Figure 2I:
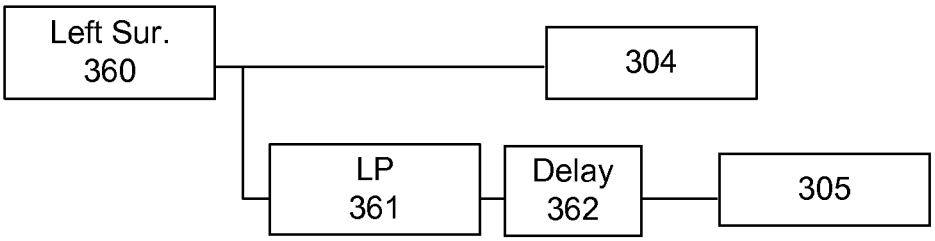

FIG. 2I shows the signal processing for the left surround channel 360. The signal from the left surround channel 360 is split between the left firing transducer 304 and the right firing transducer 305. The left surround channel 360 is sent directly to the left firing transducer 304 without any filtering, inversion, or other operation. For the right firing transducer 305, the left surround channel 360 is sent through a low pass filter 361 and a delay module 362 before the signal is sent to the right firing transducer 305.

Figure 2J:
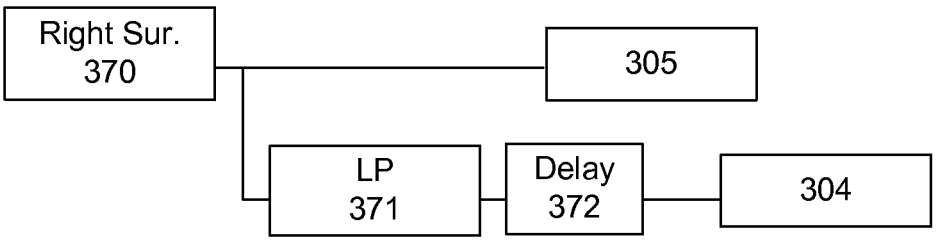

FIG. 2J shows the signal processing for the right surround channel 370. The signal from the right surround channel 370 is split between the left firing transducer 304 and the right firing transducer 305. The right surround channel 370 is sent directly to the right firing transducer 305 without any filtering, inversion, or other operation. For the left firing transducer 304, the right surround channel 370 is sent through a low pass filter 371 and a delay module 372 before the signal is sent to the left firing transducer 304.

In the embodiment shown in FIGS. 2A-J, virtual surround can be created from the side firing transducers. Shading by enclosure and the natural beaming of the transducers help to create the virtual surround effect for a listener in the listening area.

Two Speaker Sound Bar

Figure 3A:
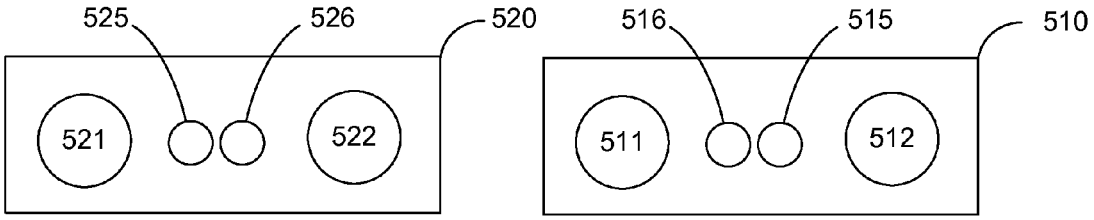
FIG. 3A shows an exemplary embodiment of a virtual surround sound system.

According to another embodiment, two speakers are used to create virtual surround sound. FIG. 3A illustrates an example of a two speaker embodiment. According to some embodiments, a left 530, left surround 540, right 550, and right surround channel 560 are used in the speaker system as shown in FIGS. 3B-3E. As shown in FIG. 3F, the center channel 570 can be mixed to the left 571 and right 572 channels prior to virtual surround processing. The left and right sides are mirror images of each other, so only the left side will be explained in detail. For example, if left signal 530 is shown being routed to transducer 525 on left speaker 520, then the corresponding right signal 550 would be transmitted from transducer 515 on the right speaker 510.

In many dipole beamforming setups, getting the transducers close together in order to optimize the canceling effect is a problem. As mentioned previously, the quarter-wavelength rule dictates the optimum distance between the centers of transducers of a dipole pair for canceling certain frequencies. For a high frequency dipole pair, this lends itself to closely spaced small drivers. Additionally, dipole beamforming at low frequencies may cause some sound to cancel. Thus, the low frequencies may need to be more efficient in this region and may need to be boosted to create a better surround sound experience. In various two speaker embodiments, these problems are addressed by having dipole arrays of different sized drivers optimized for lower and higher frequencies and by having an additional set of drivers to boost low frequencies.

In the embodiment shown in FIG. 3A, two separate speakers are shown 510 and 520. Each speaker is comprised of two dipole beamforming arrays. The array pairs in left speaker 520 are transducers 521 and 522, and transducers 525 and 526. Similarly, the array pairs in right speaker 510 are transducers 511 and 512, and transducers 515 and 516. The transducer array between 521 and 522 of the left enclosure and 511, and 512 of the right enclosure provide low frequency dipole beam-forming while transducer pairs 525/526 and 516/515 provide high frequency dipole beam-forming for the left and right speakers, respectively. Some embodiments may use a subwoofer 580 in a separate enclosure to further reinforce the low frequency sounds.

According to one embodiment, transducers 511 and 512 are a low frequency woofer array. Similarly, 521 and 522 are also a low frequency woofer array. Transducers 515-516 and 525-526 are high frequency tweeter arrays. According to one embodiment, the high frequency tweeter array is centered at 2.5 KHz. According to one embodiment, the low frequency woofer arrays are centered at 800 Hz.

If the transducers are centered on the frequencies listed above, the quarter-wavelength spacing rule may dictate the desirable separation of the transducers. According to one embodiment, transducer pairs 521 and 522 are separated by 11 cm between their centers. Similarly, 511 and 512 are separated by 11 cm between their centers. Transducers 525 and 526 are separated by 3.4 cm between their centers according to one embodiment. Similarly, transducers 516 and 515 are separated by 3.4 cm between their centers according to one embodiment.

Figure 3B:
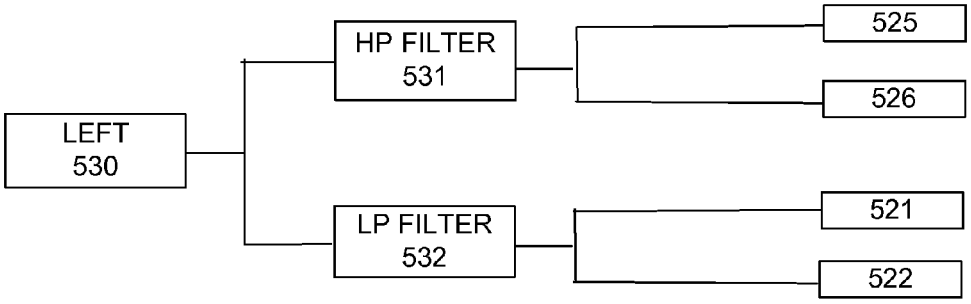
FIGS. 3B-G show exemplary signal processing diagrams for the embodiment illustrated in FIG. 3A.
Figure 3C:
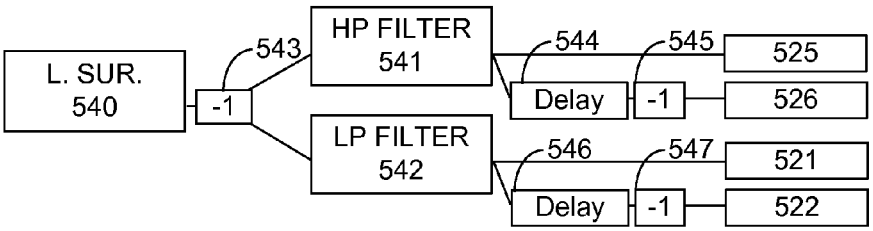
Figure 3D:
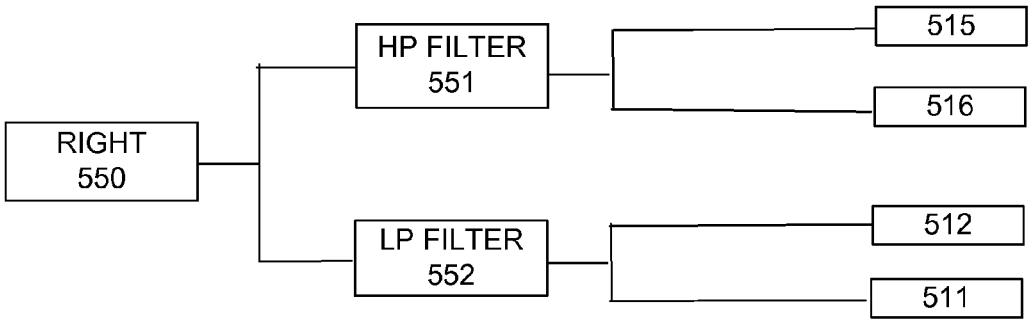
Figure 3E:
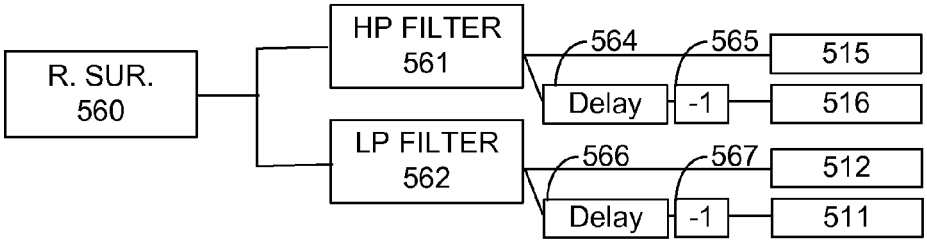
Figure 3F:
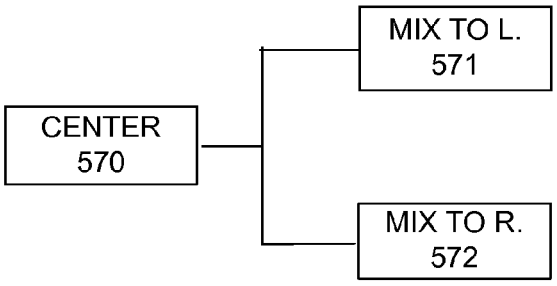
Figure 3G:
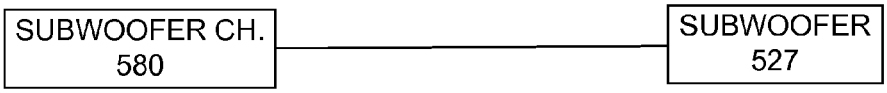

FIGS. 3B and 3C illustrate the signal processing according to one embodiment. As previously mentioned, while FIGS. 3B and 3C show the left-sided channels, the right-sided channel shown in FIGS. 3D and 3E would simply be the mirror image of what is presented in FIGS. 3B and 3C. However, one difference between the left surround channel 540 and the right surround channel 560 is that the left surround channel has its signal inverted by an inverter 543 before the signal is divided by frequency. Alternately, the right surround channel could be inverted instead of the right surround channel. The condition is that they are out of phase with each other.

As with the embodiment shown in FIG. 3A, four channels of sound can be used with various embodiments: a left 530, left surround 540, right, and right surround. Various embodiments may use more channels, such as by including a center channel 570 or a subwoofer channel 580, and various embodiments may use fewer channels, such as only a left channel and a right channel. The center channel 570 input can be mixed into the left and right channel prior to surround processing. Additionally, the left and right channel may be processed as surround channels to widen the stereo image. These channels can be sent to various embodiments from an audio source using well-known means.

FIG. 3B shows the signal processing for the left channel 530. The signal from the left channel 530 is split into its high frequency and low frequency components. The high frequency signal can be sent to the tweeter dipole pair 525 and 526. The low frequency signal can be sent to the left woofers 521, 522.

FIG. 3C shows the signal processing for the left surround channel 540. The left surround channel is inverted by an inverter 543 and then split into its high frequency and low frequency components. For this implementation with the left surround channel inverted, the right surround channel would be non-inverted. Additionally, this can be reversed such that the right surround channel is inverted with the left surround channel non-inverted. The high frequency component of the surround channel, after passing through a high pass filter, is sent to transducer 525. The high frequency component is also sent through a delay module 544 and inverted again 545 before being sent to transducer 526. According to some embodiments, the delay module 544 might introduce a 0.045 ms delay to the signal, where the delay is tuned to correspond to the desired listening position. The low frequency component, after passing through a low pass filter is sent to transducer 521. The low frequency component is also sent through a delay module 546 and inverted again 547 before being sent to transducer 522. According to some embodiments, the delay module 546 might introduce a 0.181 ms delay to the signal, where the delay is tuned to correspond to the desired listening position.

Alternative embodiments could apply dipole beamforming to the left signal and right signal in addition to the left surround and right surround signals. Various embodiments may use the left and right outputs from a computer or television without the use of any center or surround channels. The left and right outputs may be processed like surround channels to achieve a wider stereo image. According to various embodiments, one channel of surround is inverted.

Four Sound Bar

Figure 5A:
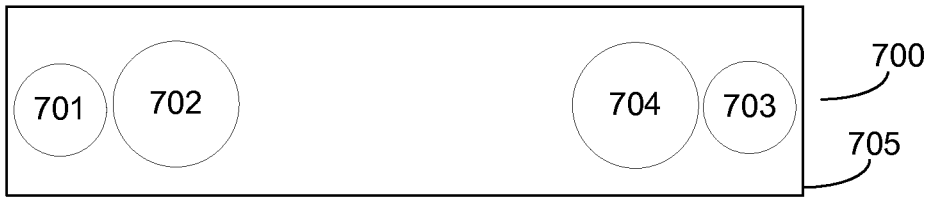
FIG. 5A shows an exemplary embodiment of a virtual surround sound system.

FIG. 5A is a simplified schematic of a sound bar 700 according to one embodiment of the present invention. Sound bar 700 includes a set of transducers, where the transducers are labeled with the reference numbers 701, 702, 703, and 704. Sound bar 700 may have more or fewers transducers according to alternative embodiments. The set of transducers may be disposed in an enclosure 705. A variety of audio channels may be supposed to sound bar 700. According to some embodiments, the sound bar is configured to receive a left channel 710, a left surround channel 740, a right channel 720, a right surround channel 750, and a center channel 730. FIGS. 5B-5G show the routing of the foregoing described audio channels to the set of transducers in sound bar 700.

The foregoing list of possible channels transmitted to the transducers in sound bar 700 may include various other audio channels according to various alternative embodiments. For example, to extract specific content a combination channel 760 may be transmitted to one or more of transducers 701-704. According to one embodiment, combination channel 760 may include left channel 710 minus right channel 720, and/or left surround channel 740 minus right surround channel 750.

Audio processing for a virtual surround sound effect may be applied to left surround channel 740, right surround channel 750, and combination channel 760. According to some embodiments, audio processing for virtual surround sound effects may be applied to left channel 710 and right channel 720 by processing through the left surround channel 740 and right surround channel 750. The audio processing flow for the left channel and the right channel may be substantially similar to the audio processing flows shown in FIGS. 5E and 5F, respectively. Other channels may also be processed for virtual surround sound effect. According to some embodiments, a separate subwoofer may also be operated in conjunction with sound bar 700 to provide for improved generation of low frequency sound.

According to one embodiment, sound bar 700 is configured as a two stage dipole beamforming array to provide enhanced virtual surround sound with relatively high constant directivity. The two stage dipole beamforming array may be divided into a low-frequency array and two-high frequency arrays. The low-frequency arrays and the high-frequency array are configured to create virtual surround sound at their respective frequencies. According to one embodiment, low frequencies are considered to be frequencies up to 1 khz, and high frequencies are considered to be frequencies between 1.5 khz and 6 khz. The transducers may be different sizes. For example, transducers 701 and 703 may be smaller than transducers 702 and 704. Transducers 701 and 703 may be the same size, and transducers 702 and 704 may be the same size. According to one or more alternative embodiments, transducers 701, 702, 703, and 704 may have sizes different from the sizes described above and shown in FIG. 5A. For example, transducers 701, 702, 703, and 704 may be the same size, or transducers 701 and 703 may be larger than transducers 702 and 704. References to the size of the transducers can be understood to mean transducers that have varying frequency regions of operation and varying dispersion characteristics. Further details on how the sound arrays are described below.

According to one embodiment, outer transducers 701 and 703 are tweeters, and the inner transducers 702 and 704 are woofers. The inner transducers 702 and 704 may be configured as a low frequency array, where the center frequency of the low frequency array may be determined by the quarter wavelength equal to the center to center distance between the centers of the inner transducers. The transducers 701 and 702 may be configured to form a high frequency array. Similarly, transducers 703 and 704 may be configured to form a high frequency array. The center frequency of the high frequency arrays is determined by the center to center distance between transducers 701 and 702, and between transducers 703 and 704.

Figure 5B:
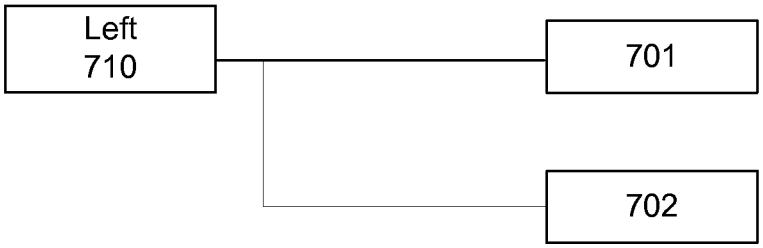
FIGS. 5B-G show exemplary signal processing diagrams for the embodiment illustrated in FIG. 5A.
Figure 5C:
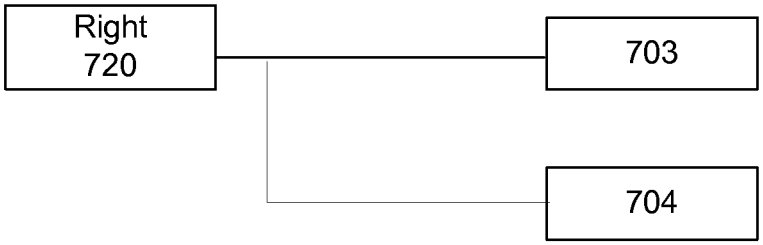
Figure 5D:
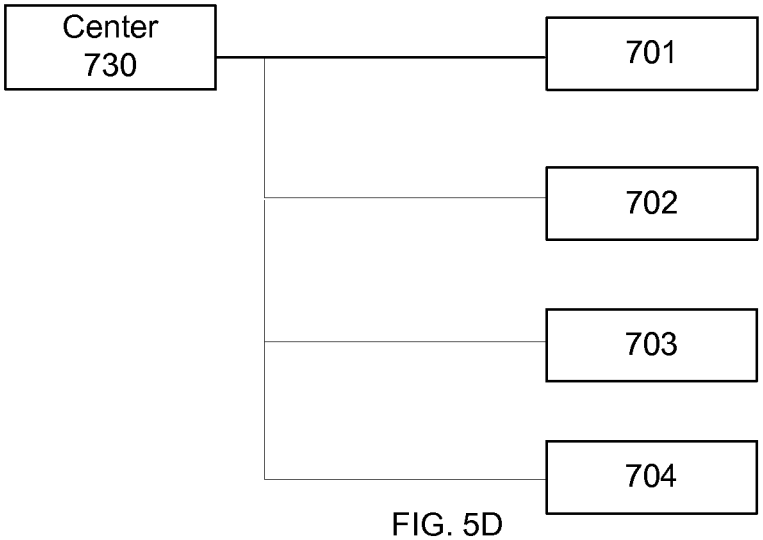

FIGS. 5B-5G show the signal processing used to implement a two stage dipole beamforming array according to one embodiment. FIG. 5B shows the signal processing for the left channel 710. The audio signals from the left channel 710 are sent to transducers 701 and 702. FIG. 5C shows the signal processing for the right channel 720. The audio signals from the right channel 720 are sent to transducers 703 and 704. FIG. 5D shows the signal processing for the center channel 730. The audio signals from the center channel 730 are sent to each of transducers 701-704.

Figure 5E:
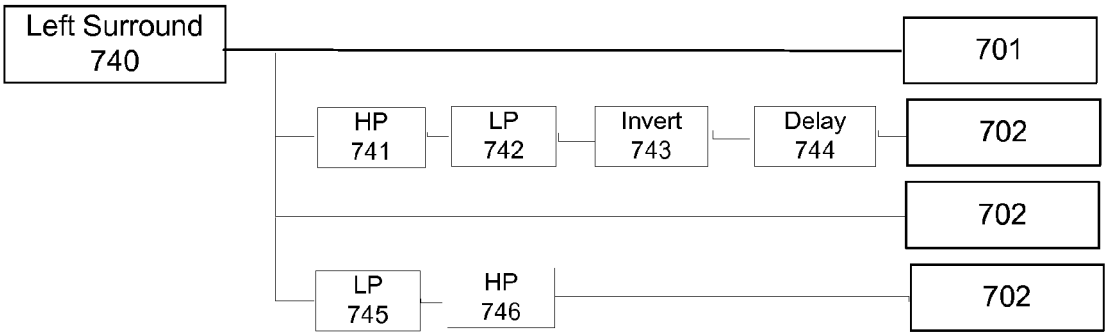

FIG. 5E shows the signal processing for the left surround channel 740. The left surround channel 740 is split into a set of frequency bands (e.g., three frequency bands: low, middle, and high). The transducers 701 and 702 may each receive the left surround channel 740 without virtual surround processing. Transducer 701 may form a high frequency dipole pair with transducer 702 in the optimized frequency region defined by a high pass filter 741 and a low pass filter 742. And inverter 743 and a delay 744 may be configured to create the dipole array. In some embodiments, the high pass filter may be 1.5 kHz high pass filer, and the low pass filter may be 6 kHz low pass filter. Transducer 702 also forms a low frequency array with transducer 704. The low frequency array of transducer 702 and 704 provides for both the left surround 740 channel and the combination 760 channel to be transmitted over the optimized frequency region defined by the high pass filters 745 and 761, and the low pass filters 746 and 762.

Figure 5F:
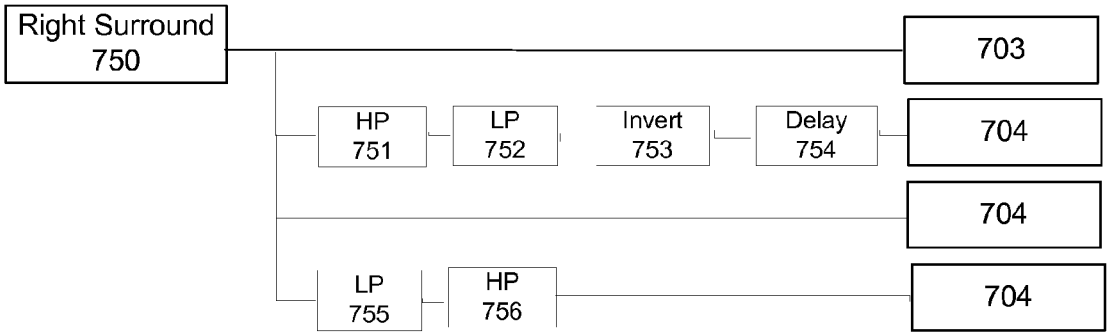
Figure 5G:
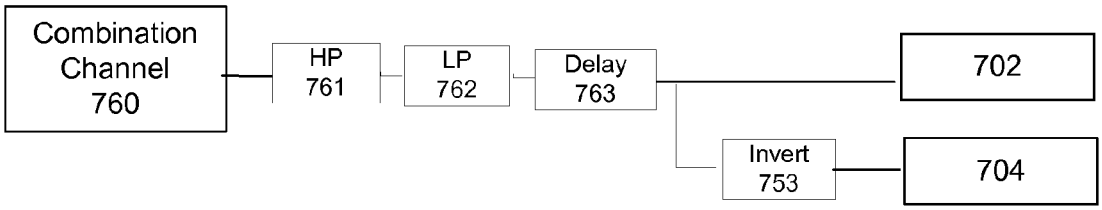

FIG. 5F shows the signal processing for the right surround channel 750. The right surround channel 750 is split into a set of frequency bands (e.g., three frequency bands: low, middle, and high). Transducer 703 may receive the right surround channel 750 without virtual surround processing, and transducer 704 may receive the right surround channel 750 without virtual surround processing. Transducer 704 may form a high frequency dipole pair with transducer 703 where the high frequency pair is configured to operate in the optimized frequency span defined by high pass filter 751 and low pass filter 752. Inverter 753 and delay 754 may be configured to create the dipole array. In some embodiments, the high pass filter may be 1.5 kHz filter and the low pass filter may be 6 kHz filter. Transducer 704 also forms a low frequency array with transducer 702 with both the right surround channel 750 and the combination channel 760 operating over an optimized frequency region defined by the high pass filters 755 and 761, and the low pass filters 756 and 762.

Having described and illustrated the principles of various embodiments of the invention, it will be apparent to one skilled in the art that embodiments can be modified in arrangement and detail without departing from scope and purview of the described embodiments. Many of the examples described herein are intended to be illustrative and not limiting to the claims. For example, any of the software components or functions described in this application, may be implemented as software code to be executed by the controller or the processor using any suitable computer language such as, assembly code, C, or C++ using, for example, conventional or object-oriented techniques. The software code may be stored as a series of instructions, or commands on a computer readable medium, such as a random access memory (RAM), a read only memory (ROM), a magnetic medium such as a hard-drive or a floppy disk, flash drive, or an optical medium such as a CD-ROM. Any such computer readable medium may reside on or within a single computational apparatus, and may be present on or within different computational apparatuses within a system or network. It is noted that the recitations of "a", "an" or "the" herein are intended to mean "one or more" unless specifically indicated to the contrary. A set as referred to herein includes one or more elements. Further, all patents, patent applications, publications, and descriptions mentioned above are incorporated by reference herein in their entireties for all purposes. None is admitted to be prior art.

What is claimed is:

1. A speaker system comprising:

a speaker enclosure;

a first array of transducers mounted in the speaker enclosure and having a first lateral displacement;

at least a second array of transducers in the speaker enclosure and having a second lateral displacement, which is larger than the first lateral displacement, wherein the second array is configured to operate as a low-frequency array and the first array is configured to operate as a high-frequency array, and wherein the second array comprises at least one transducer of the first array; wherein:

the transducers included in the first array are configured to operate in a frequency region covering at least the frequency ranges of the first array and the second array, and a speaker input port; and a controller operatively coupled with the speaker input port, wherein the controller is configured to provide an electronic-audio signal to the transducers such that the first array and the second array mounted in the speaker enclosure are tuned to different center frequencies and are a two stage dipole beamforming array, and the controller further configured to provide an electronic-audio signal to the transducers such that the first array forms a high frequency dipole array in an optimized frequency region defined by a high pass filter and a low pass filter.

2. The speaker system of claim 1, wherein the second array is a mixed input channel array.

3. The speaker system of claim 1, wherein the first array and the second array together include at least a first transducer, a second transducer, and a third transducer.

4. The speaker system of claim 3, wherein the first transducer and the second transducer form the high-frequency array, and the first second transducer and the third transducer form the low-frequency array.

5. The speaker system of claim 3, further comprising a fourth transducer and wherein:

the first transducer is a tweeter configured for a high frequency region of operation and the second transducer is a woofer configured for a low-frequency region of operation, the third transducer is a woofer configured for a low-frequency region of operation and the fourth transducer is a tweeter configured for a high-frequency region of operation, and the woofers and tweeters have a frequency region of operation that overlaps and are configured for dipole beamforming of the high-frequency array.

6. The speaker system of claim 5, wherein the first transducer, second transducer, third transducer, and fourth transducer have substantially similar frequency regions of operation.

7. The speaker system of claim 5, wherein the controller is configured to:

route a left channel of the electronic-audio signal to the first transducer and the second transducer, route a right channel of the electronic-audio signal to the third transducer and the fourth transducer, and route a center channel of the electronic-audio signal to the first transducer, the second transducer, the third transducer, and/or the fourth transducer.

8. The speaker system of claim 7, wherein the controller is configured to separate a right-surround channel of the electronic-audio signal into a first and a second frequency band, and wherein:

the first frequency band of the right-surround channel is combined with the left-surround channel and is transmitted to the second and the fourth transducers, wherein the right-surround channel and the left-surround channel are processed as a low frequency band-limited dipole beamforming array.

9. The speaker system of claim 8, a combined channel is configured to have arbitrary gains applied to component channels forming the combined channel.

10. The speaker system of claim 8, the second frequency band of the right-surround channel is mid-band filtered, and is processed to create a dipole beamforming array between the third and the fourth transducers, wherein a leftward spaced transducer is inverted and delayed with respect to a more rightward transducer.

11. The speaker system of claim 10, wherein the controller is configured to separate a left-surround channel of the electronic-audio signal into a first and a second frequency band, and wherein:

the first frequency band of the left-surround channel is combined with the right-surround channel and is transmitted to the second and the fourth transducers, wherein the left-surround channel and the right-surround channel are processed as a low-frequency band-limited dipole beamforming array.

12. The speaker system of claim 11, wherein the second frequency band of the left-surround channel is mid-band filtered, and is processed to create a dipole beamforming array between the first and second transducers, where the more rightward transducer is inverted and delayed with respect to the more leftward transducer.

13. The speaker system of claim 5, wherein a combination channel of the electronic-audio signal is frequency band-limited to produce the low-frequency array.

14. The speaker system of claim 13, wherein the combination channel is configured to combine the left channel, the right channel, the center channel, the left-surround channel, and the right surround channel with arbitrary gains for surround-effect processing.

15. The speaker system of claim 1, further comprising a third array of transducers having the first lateral displacement, wherein the third array is a high-frequency array and is configured to have operating frequency regions covering at least the frequency ranges of the first array, the second array; and the third array.

16. The speaker system of claim 1, wherein the first array and the second array are configured for combined operation with a set of side firing transducers for enclosure shading and transducer directionality to produce virtual surround.

17. The speaker system of claim 1, further comprising at least one additional laterally spaced dipole beamforming array.

18. The speaker system of claim 8, wherein low-frequency signals of the first low-frequency array are determined by dipole beamforming array quarter-wavelength spacing, wherein an array usable frequency region is within +/−2 octaves about the array center frequency f_c, where f_c=c/(4d).

19. The speaker system of claim 1 wherein the first array comprises two transducers and the second array comprises two transducers.

20. The speaker system of claim 1 wherein the speaker enclosure comprises a front face and wherein:

each transducer of the first array of transducers has a sound emitting side, each transducer of the second array of transducers has a sound emitting side, and wherein the first array of transducers and the second array of transducers are positioned in the speaker enclosure so that the sound emitting side of each transducer is facing out from the front face of the speaker enclosure.

21. The speaker system of claim 1 wherein:

the first array includes a first transducer and a second transducer; and the second array includes the second transducer and a third transducer.

22. The speaker system of claim 21 further comprising:

a third array of transducers mounted in the speaker enclosure having a third lateral displacement, the third array including the third transducer and a fourth transducer.

23. The speaker system of claim 22 wherein the first transducer is a tweeter, the second transducer is a woofer, the third transducer is a woofer, and the fourth transducer is a tweeter.

24. The speaker system of claim 1 further comprising:

a third array of transducers mounted in the speaker enclosure having a third lateral displacement.

25. The speaker system of claim 1 wherein the first array further comprises an inverter and a delay configured to create the dipole array.

26. The speaker system of claim 1 wherein the high pass filter is a 1.5 kHz high pass filter.

27. The speaker system of claim 1 wherein the low pass filter is a 6 kHz low pass filter.

28. The speaker system of claim 1 wherein the controller is further configured to provide an electronic-audio signal to the transducers such that the second array provides for both a left surround channel and a combination channel to be transmitted over an optimized frequency region defined by high pass filters and low pass filters.

29. The speaker system of claim 1 further comprising a third array of transducers configured to operate as a high frequency array.

30. The speaker system of claim 29 wherein the controller is further configured to provide an electronic-audio signal to the transducers such that the third array forms a high frequency dipole array configured to operate in an optimized frequency span defined by a high pass filter and a low pass filter.

31. The speaker for claim 29 wherein an inverter and a delay are configured to create the diploe array.

32. A speaker system comprising:

a speaker enclosure;

a first array of transducers mounted in the speaker enclosure and having a first lateral displacement;

at least a second array of transducers in the speaker enclosure and having a second lateral displacement, which is larger than the first lateral displacement, wherein the second array is a low-frequency array and the first array is a high-frequency array; wherein:

the transducers included in the first array are configured to have an operating frequency region covering at least the frequency ranges of the first array and the second array, and a speaker input port; and a controller operatively coupled with the speaker input port, wherein the controller is configured to provide an electronic-audio signal to the transducers such that the first array and the second array are tuned to different center frequencies and are a two stage dipole beamforming array, wherein the first array and the second array together include at least a first transducer, a second transducer, and a third transducer, and the speaker system further comprises a fourth transducer, wherein the controller is further configured to:

route a left channel of the electronic-audio signal to the first transducer and the second transducer, route a right channel of the electronic-audio signal to the third transducer and the fourth transducer, route a center channel of the electronic-audio signal to the first transducer, the second transducer, the third transducer, and/or the fourth transducer, and separate a right-surround channel of the electronic-audio signal into a first and a second frequency band, and wherein the first frequency band of the right-surround channel is combined with the left-surround channel and is transmitted to the second and the fourth transducers, wherein the right-surround channel and the left-surround channel are processed as a low frequency band-limited dipole beamforming array, wherein low-frequency signals of the first low-frequency array are determined by dipole beamforming array quarter-wavelength spacing, wherein an array usable frequency region is within +/−2 octaves about the array center frequency $f_c$, where $f_c=c/(4d)$.

* * * * *